US010383780B2

(12) United States Patent
Jordan et al.

(10) Patent No.: US 10,383,780 B2
(45) Date of Patent: Aug. 20, 2019

(54) BED

(71) Applicant: LINET SPOL. S.R.O., Slaný (CZ)

(72) Inventors: Michal Jordan, Polesovice (CZ); Marek Hartman, Slany (CZ); Vladimir Jurka, Unhost (CZ)

(73) Assignee: LINET SPOL. S R.O., Slany (CZ)

( * ) Notice: Subject to any disclaimer, the term of this patent is extended or adjusted under 35 U.S.C. 154(b) by 48 days.

(21) Appl. No.: 14/902,503

(22) PCT Filed: Aug. 14, 2014

(86) PCT No.: PCT/CZ2014/000089
§ 371 (c)(1),
(2) Date: Dec. 31, 2015

(87) PCT Pub. No.: WO2015/021950
PCT Pub. Date: Feb. 19, 2015

(65) Prior Publication Data

US 2016/0143796 A1 May 26, 2016

(30) Foreign Application Priority Data

Aug. 15, 2013 (CZ) ..... PV 2013-630

(51) Int. Cl.
*A61G 7/018* (2006.01)
*A61G 7/08* (2006.01)
(Continued)

(52) U.S. Cl.
CPC ..... *A61G 7/018* (2013.01); *A61G 1/0275* (2013.01); *A61G 7/0528* (2016.11); *A61G 7/08* (2013.01);
(Continued)

(58) Field of Classification Search
CPC combination set(s) only.
See application file for complete search history.

(56) References Cited

U.S. PATENT DOCUMENTS 5,083,625 A 1/1992 Bleicher
5,316,096 A * 5/1994 Good ..... A45C 5/14 180/19.1
(Continued)

FOREIGN PATENT DOCUMENTS

CA 2469462 12/2009
EP 2298263 B1 3/2011
(Continued)

OTHER PUBLICATIONS

WIPO, International Search Report, in International Application No. PCT/CZ2014/000089, filed Aug. 14, 2014, dated Jan. 8, 2015.
(Continued)

*Primary Examiner* — Anne M Antonucci
*Assistant Examiner* — Renee LaRose
(74) *Attorney, Agent, or Firm* — Thedford I. Hitaffer; Hitaffer & Hitaffer, PLLC

(57) ABSTRACT

Bed with system for propelling the bed including motorized wheel, drive for propelling, processor unit and control member. Using the controller connected via the processor unit to the drive for propelling of the motorized wheel it is possible to change the modes of the motorized wheel. In the first mode the movement of the motorized wheel is dependent on the drive for propelling, whereas in the second mode the motorized wheel rotates independently of the drive for propelling. Using the system for propelling the bed it is thus possible to start the bed moving in the selected direction, in manual mode or in braking mode.

19 Claims, 4 Drawing Sheets

(51) Int. Cl.
*A61G 7/05* (2006.01)
*A61G 1/02* (2006.01)

(52) U.S. Cl.
CPC ..... *A61G 2203/12* (2013.01); *A61G 2203/16* (2013.01); *A61G 2203/30* (2013.01)

(56) References Cited

U.S. PATENT DOCUMENTS

| | | | | |
|---|---|---|---|---|
| 5,806,111 | A | 9/1998 | Heimbrock et al. | |
| 6,330,926 | B1 | 12/2001 | Heimbrock et al. | |
| 6,505,359 | B2 | 1/2003 | Heimbrock et al. | |
| 6,752,224 | B2 | 6/2004 | Hopper et al. | |
| 6,772,850 | B1 | 8/2004 | Waters | |
| 7,007,765 | B2 | 3/2006 | Waters et al. | |
| 7,090,041 | B2 | 8/2006 | Vogel et al. | |
| 7,419,019 | B1 | 9/2008 | White | |
| 2003/0090465 | A1* | 5/2003 | Dellinger | G06F 3/014 345/167 |
| 2006/0059623 | A1* | 3/2006 | Karmer, Jr. | A61G 7/012 5/616 |
| 2008/0141459 | A1 | 4/2008 | Hemberg | |
| 2008/0098525 | A1 | 5/2008 | Doleschal | |
| 2009/0188731 | A1 | 7/2009 | Zurhusen | |
| 2009/0222184 | A1 | 9/2009 | Bhai | |
| 2010/0298053 | A1* | 11/2010 | Kotkin | A63F 13/24 463/37 |
| 2011/0015842 | A1 | 1/2011 | Kume | |
| 2011/0087416 | A1* | 4/2011 | Patmore | A61G 1/048 701/93 |
| 2011/0277241 | A1 | 11/2011 | Schejbal | |
| 2013/0318710 | A1* | 12/2013 | Hamberg | A61G 7/018 5/425 |
| 2014/0059768 | A1* | 3/2014 | Lemire | A61G 7/005 5/611 |

FOREIGN PATENT DOCUMENTS

| | | | |
|---|---|---|---|
| EP | 2624106 | | 8/2013 |
| WO | 2009113009 | A1 | 9/2009 |

OTHER PUBLICATIONS

WIPO, Written Opinion, in International Application No. PCT/CZ2014/000089, filed Aug. 14, 2014, dated May 18, 2015.

WIPO, International Preliminary Report on Patentability, in International Application No. PCT/CZ2014/000089, filed Aug. 14, 2014, dated Dec. 2, 2015.

WIPO, International Search Report, completed Jan. 30, 2015, in International Patent Application No. PCT/CZ2014/000110, filed on Oct. 3, 2014.

WIPO, Written Opinion of the International Searching Authority, dated Dec. 22, 2014, in International Patent Application No. PCT/CZ2014/000102, filed on Sep. 17, 2014.

* cited by examiner

BED

CROSS-REFERENCE TO RELATED APPLICATIONS

This application, filed under 35 USC 371, is a United States National Stage Application of International Application No. PCT/CZ2014/000089, filed Aug. 14, 2014, which claims priority to CZ Application No. PV 2013-630, filed on Aug. 15, 2013, the disclosures of which are incorporated herein by reference.

TECHNICAL FIELD

The invention is related to a bed for maintaining a patient in the horizontal position, for example, a hospital bed, nursing bed, examination bed, stretcher, etc., including a system for propelling the bed in the form of a motorized wheel for handling the bed in motor-powered movement, in manual movement and in braking mode. The manual mode allows the free rotation of the wheel. The motorized wheel is controlled via a controller comprising at least two activation members. By using more than one activation member, bed-handling safety is increased when in the motorized (i.e., motor-powered) mode, and via a combination of activation members, it also makes it possible to choose between the individual methods of movement, thus between motorized movement, manual movement and braking.

BACKGROUND ART

In hospital environments, the transport of patients on a hospital bed or of the hospital beds themselves is required. For this reason, beds are fitted with a system of casters allowing handling. But the handling of heavy beds, or beds with a patient, can be physically uncomfortable. For this reason, hospital beds are equipped with additional systems for propelling a bed, for example, in the form of a motorized wheel, making bed transport easier for hospital personnel. The aforementioned system constitutes a known state of art, for example, according to U.S. Pat. Nos. 5,806,111, 6,505,359 or 7,090,041.

The motorized wheel is connected to the undercarriage and can be forced against the ground for the purposes of motorised movement or retracted into the undercarriage for the purposes of handling the bed without engagement of motorised movement, as in patent application EP2298263.

One important element of the system for propelling a bed is its control equipment. In one common embodiment, such as, in the U.S. Pat. No. 6,330,926, the bed is equipped with push bars having a mechanical switch by which the user activates the motorized movement of the bed. Another of the alternatives, according to U.S. Pat. No. 6,752,224, is the control of a drive system via push bars equipped with force sensors located between the push bars and the bed. These sensors convert the force, which arises, for example, through the movement of the push bars in the required direction of travel, to a signal controlling the bed's movements. The push bars in the aforementioned patent can be equipped with a user presence detector, which is implemented, for example, using a force sensor. Alternatively, an air or liquid pressure sensor or capacity sensor can be used for this purpose.

In the known state of art, the system for propelling a bed is activated by a main switch located on the undercarriage near the battery (U.S. Pat. No. 6,330,926), and which connects the motor and the battery. Without switching on the main switch, it is possible to manipulate the bed manually, without the use of an additional system for powering the bed, in this specific example, thanks to a clutch.

Another known solution for propelling a bed is implemented in the form of a motorized wheel capable of rotating around a vertical axis, which enables the user to move the bed in all directions. This solution is contained, for example, in patent application WO2009113009.

Motorized movement of a bed entails danger, in cases where the personnel stops controlling the bed as a result of an accident or inattention. For these cases, safety elements are included in the bed control, intended to brake the bed. In this way, the bed is essentially braked for safety reasons in cases where the control of the bed by the personnel is interrupted. So, in U.S. Pat. No. 7,007,765, the bed is braked by the friction of unpowered drive for propelling, if the pressing of the mechanical switch is interrupted. One common means of braking a bed is by shorting out the motor. Such a solution is described in patent CA2469462, for example. One problem of beds allowing motorized movement, compared with conventional non-propelled beds, is their more difficult manipulation in a tight space, because the beds are often only capable of motorized movement in one or more directions, and braking. Another shortcoming of beds with a motorized system is the necessity of drawing power from batteries even during a very small movement of the bed. For systems in the known state of art, it is not possible for the operator to make fine movements to a bed using their own power, if the main or another separate switch is not used, for disconnection of the shorting circuit of the motor, or for activation of the clutch. For this reason, it is very difficult for the user to switch from motorized movement to manual mode, enabling the wheel to rotate freely.

The aim of this invention is to propose a solution for controlling the drive system of a hospital bed, ensuring for the hospital personnel safe and practical handling of the bed in the motorized movement, manual movement and bed braking modes.

SUMMARY OF THE INVENTION

The specified problems are solved by a bed for maintaining a patient in a horizontal position, which includes a mattress platform, undercarriage with casters and a system for propelling the bed. The system for propelling the bed includes a motorized wheel, drive for propelling, processor unit and controller. The controller is used for switching between the modes in which the motorized wheel works. In one of the modes, the wheel rotates freely, so it is not dependent on the drive for propelling, and in the second of the modes the wheel rotates only in one of the selected directions. In a preferred embodiment, the drive for propelling may be connected to batteries in at least two of the aforementioned modes.

In a preferred embodiment, the controller contains a touch sensor. The touch sensor is in the form of a capacity sensor. This sensor may be located proximate to the control member so it is possible to activate the touch sensor and control member at the same time using one hand. In another embodiment, it is possible to use another type of touch sensor, for example, a resistive, inductive or optical sensor, a sensor using the technology of surface acoustic waves (SAW) or infrared radiation, a temperature sensor, etc. The touch sensor may be connected to the processor unit to activate the controlmember. The touch sensor may be located on the upper side of the controller.

In a preferred embodiment, the bed may be equipped with a light and/or acoustic indicator for warning of a problem state or a low battery state.

In another embodiment, the system for propelling the bed is connected to a button for activation of the system, and which is on the panel located on the bed frame.

The controller can include at least one button for movement forward and at least one button for movement backwards. The controller can also include a brake button.

DETAILED DESCRIPTION OF THE DRAWINGS

Figure 1:
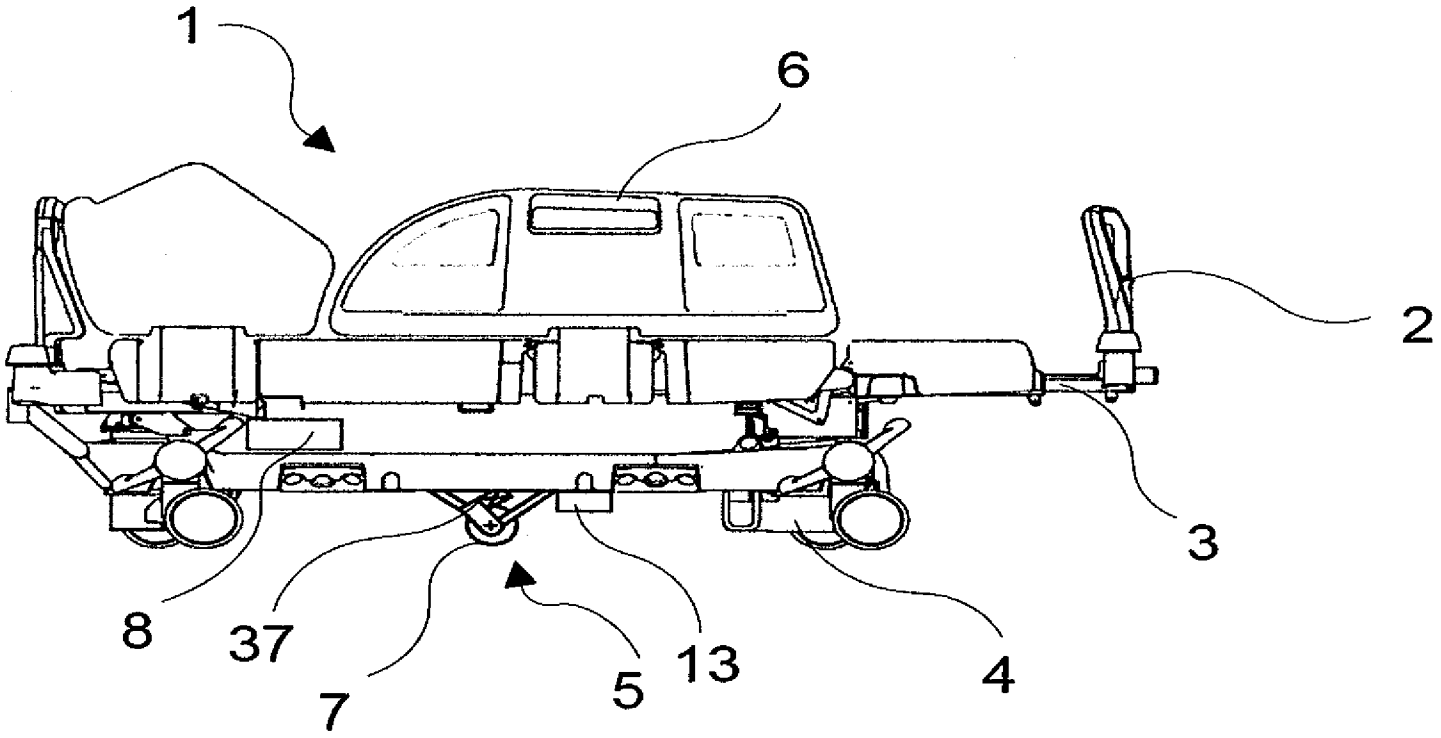
FIG. 1 shows a hospital bed.
Figure 2:
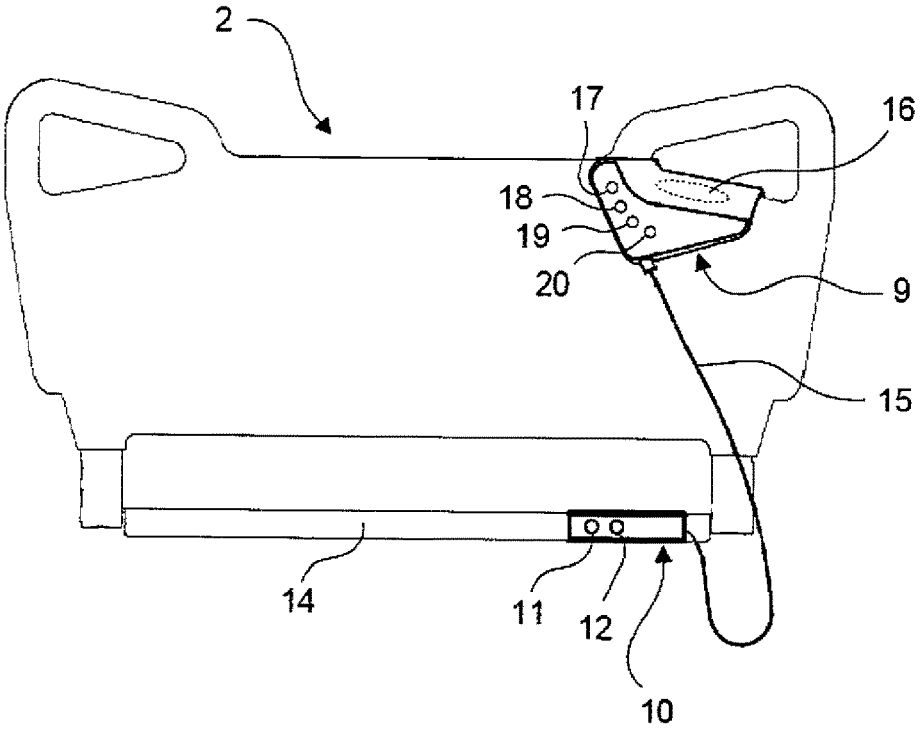
FIG. 2 shows a relevant portion of a bed, to which a controller attached, and a frame of the bed coupled with the control panel.

FIG. 1 shows a bed 1 for maintaining a patient in a horizontal position, such as, for example, a hospital bed, nursing bed, examination bed, stretcher, etc., which includes removable end boards 2, a patient support 3, an undercarriage with casters 4 and a system for propelling the bed 5. Sometimes it can also be equipped with side rails 6 and other accessories. The system for propelling the bed 5 can include a motorized wheel 7, processor unit 8, drive for positioning the wheel, drive for propelling 37 the wheel, brake, controller 9 and control panel 10 with button for system activation 11 and button for lifting 12 of a motorized wheel, as can be seen in FIG. 2. The movement of the motorized wheel 7 between an upper and lower position is performed by means of a drive for positioning the wheel (not in the figure), whereas the drive for propelling 37 controls the movement of the bed 1 in different directions. This most often involves movement backwards and forwards, but from the state of the art, it is known that the system for propelling the bed 1 may be designed so as to allow the motorized movement of the bed 1 in all directions. The motorized wheel 7 may function in three states, i.e., motorized movement, manual movement with free rotation of the wheel, or in the braked state. A person ordinary skilled in the art can, for this purpose, select a suitable motorized wheel 7 with an integrated drive for propelling 37 (for example HUB type), or a wheel suitably connected to an external drive for propelling 37. This connection to the motor can also be implemented in such a way that the system includes a clutch or in an alternative solution, for example, the possibility of disconnection, using a switch or other device, of a battery 13 from the drive for propelling 37, which drives the motorized wheel. The drives are powered by batteries 13 located near the system for propelling the bed 5, for example, on the frame 14 or on the undercarriage of the bed 4. A person of ordinary skill in the art knows in which manner it is possible to connect the aforementioned drives functionally to the motorized wheel 7. The processor unit 8 of the motorized wheel 7 is located near the motorized wheel 7, for example, fixed to the frame 14 or undercarriage 4 of the bed 1. The processor unit 8 of the motorized wheel 7 is connected via a control panel 8 to the controller 9 of the system for propelling the bed 5, which is displayed in FIGS. 2 and 3. In a different embodiment, the controller 9 is directly connected to the processor unit 8. The instructions the user gives by pressing one of the buttons 17, 18, 19, 20 on the controller 9 are processed by the processor unit 8, which, on the basis of their activation, controls one or both drives connected to the motorized wheel or the brake for the bed 1. A detailed description of the individual functions of the buttons 17, 18, 19, 20, 11, and 12 is provided below. Alternatively, the drives may also be controlled via the standard processor unit of the bed 1. The drive for positioning the wheel and the drive for propelling 37 are included amongst these drives. The motorized wheel 7 is located in the middle of the undercarriage 4 of the bed 1 so that the resultant handling of the bed 1 is as simple as possible. Another possible solution to the system for propelling the bed 5 is the use of at least two motorized wheels 7, which are then located at the edge of the frame of the undercarriage 4. Another possible embodiment may consist of replacing the motorized wheel 7 with a motorized belt. The drive of the bed 1 may also be implemented by the replacement of one or more conventional mechanical wheels with a motorized wheel 7.

FIG. 2 shows the board 2 and frame 14 of the bed 1 from the operator's viewpoint. The controller 9 of the system for propelling the bed 5 is located on the board 2, where it is hung. Alternatively, the processor unit 8 may be connected to the controller 9, which is connected or fixed to the bed 1. Such a controller 9 can be, for example, in the shape of a handrail connected as swinging around the axis of rotation on one of the frames 14 of the bed 1. In another embodiment, the controller 9 can be part of the board 2 of the bed 1. The panel 10 includes an activation button 11 serving for activation of the system for propelling the bed 5 and a button for lifting 12 the motorized wheel 7. For the purposes of increasing patient safety, this panel 10, connected by a cable 15 to the controller 9, is located sufficiently far from the controller 9 out of reach of the patient. In the alternative embodiment, the buttons 11, 12 of the control panel 10 may be in a different position on the bed 1, or even on the controller 9. The controller 9 includes three buttons for movement of the bed 18, 19, 20, one button for braking the bed 17 and a touch sensor 16. The actual movement of the bed 1 via the system for propelling the bed 5 has the advantage of being conditional on the activation of at least two control elements, these always being the touch sensor 16 and one of the three movement buttons 18, 19, 20. For example, in FIG. 2, it is shown that the controller 9 is adapted for quick attachment to the board 2 due to its shape, or alternatively to the side rails 6 of the bed 1. The ergonomic shape of the controller 9 also allows a natural means of one-handed control, where the hand is placed on the touch detector 16, and at the same time it is also possible to comfortably control the four buttons mentioned 17, 18, 19, 20. Via warning lights on the panel 10, implemented, for example, using LEDs, the status of the batteries 13 and the readiness of the bed 1 for travel is displayed to the user. In a preferred embodiment, the controller 9 can have a diode indicating a fault or forbidden user function, for example, if the user wants to start the operation of the bed 1 in spite of the fact that it is braked or plugged in the power supply.

Figure 3:
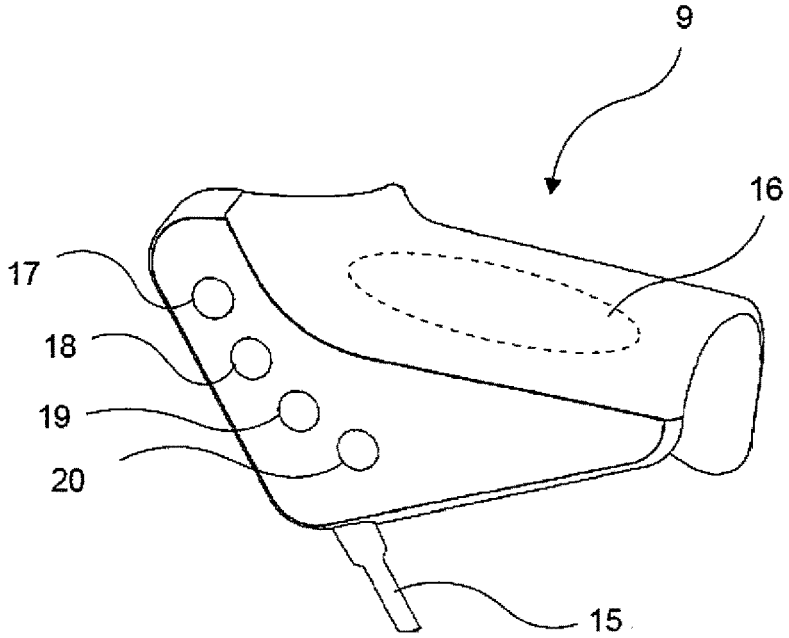
FIG. 3 shows a detailed view of the controller with function buttons.

FIG. 3 shows a detailed view of the controller 9 of the system for propelling the bed 5 including three buttons for movement of the bed 18, 19, 20, one button for braking the bed 17, and a touch sensor 16, which can be in the form of a capacity sensor, for example. An alternative embodiment is to use another type of touch sensor 16, for example, a resistive, inductive or optical sensor, a sensor using the technology of surface acoustic waves (SAW) or infrared radiation, a temperature sensor, etc. One of the embodiments for the ergonomic arrangement of the function buttons can be seen in FIG. 3, where a stop button for activation of the brake 17 is shown. The remaining three controls are for controlling the movement of the bed 1. These are a button for slow forward movement of the bed 18, button for fast forward movement of the bed 19, and button for slow reverse movement of the bed 20. In another embodiment, the controller 9 can have a larger number of buttons laid out otherwise, which, in addition to the aforementioned functions, can serve for the sideways movement of the bed 1. Another solution of design of these buttons on the controller 17, 18, 19, 20 of the system for propelling the bed 5 may be the implementation of other control elements, such as a joystick, touch sensor, user gesture sensor or other suitable control element. The functionality of the control buttons for movement 18, 19, 20 is conditional on the concurrent activation of the touch sensor 16, which means that the only button of the controller 9 not dependent on the activation of the touch sensor 16, is the button for activation of brake 17, which controls the brake on the system for propelling the bed 5. During the regular operation of the bed 1, the system for propelling the bed 5 is switched off and the brake is activated. In order for the bed 1 to start moving, for greater safety, the system for propelling the bed 5 can be switched on by pressing the activation button 11. For driving and releasing the brake, the touch sensor 16 must be used at the same time as one of the direction of movement buttons 18, 19, 20. Using the motor for movement of the bed 1 forwards can be achieved by the concurrent activation of the touch sensor 16 and buttons for forward movement 18, 19, for which the user can select two speeds. Reverse movement can be attained by the concurrent activation of the touch sensor 16 and button for reverse movement 20. To stop the movement of the bed 1 the user can use the button for activation of the brake 17, which is the only one independent of the concurrent activation of the touch sensor 16. In the case of smooth movement in one of the aforementioned directions, it is possible for the user to put the bed 1 into the manual mode, with free rotation of motorized wheel, by releasing the control button 18, 19, 20 for the designated direction of movement and, at the same time, holding down the touch sensor 16. If the bed 1 starts to move in a direction opposite to that of the last user command, the bed 1 is stopped by the brake. Detection of movement by the bed 1 in an opposite direction is achieved, for example, using a rotation sensor or by measuring the voltage generated by the motor. This mechanism prevents the bed 1 going off in a direction opposite to that given by the user command, which is useful, for example, on a sloping terrain. One of the ways in which the bed 1 can be braked is by using an electromagnetic or electromechanical brake. An alternative way of stopping the bed 1 may be implemented by a brake via motor, by shorting the power leads, or simple regulation of the performance of the motor of the system for propelling the bed 5, for example, braking by pulse wave modulation (PWM). In an advantageous embodiment, a combination of all the aforementioned mechanisms can be used to attain the smooth braking of the bed 1, sufficient protection against unintended start of bed 1 movement or, for example, regulation of bed 1 speed when moving on sloping terrain.

In an advantageous embodiment, the bed 1 can be equipped with a tilt sensor connected to the processor unit 8. Based on a signal from the sensor, the tilt of the bed 1 is evaluated, and if the bed 1 is moving on sloping terrain, the performance of the drive for propelling 37, control of the brake, drive for lifting the wheel or other elements of the system for propelling the bed are adjusted. A typical tilt sensor may be, for example, an accelerometer, a gyroscopic sensor, an electrolytic tilt sensor or other known tilt sensor, or a combination of them.

Figure 5:
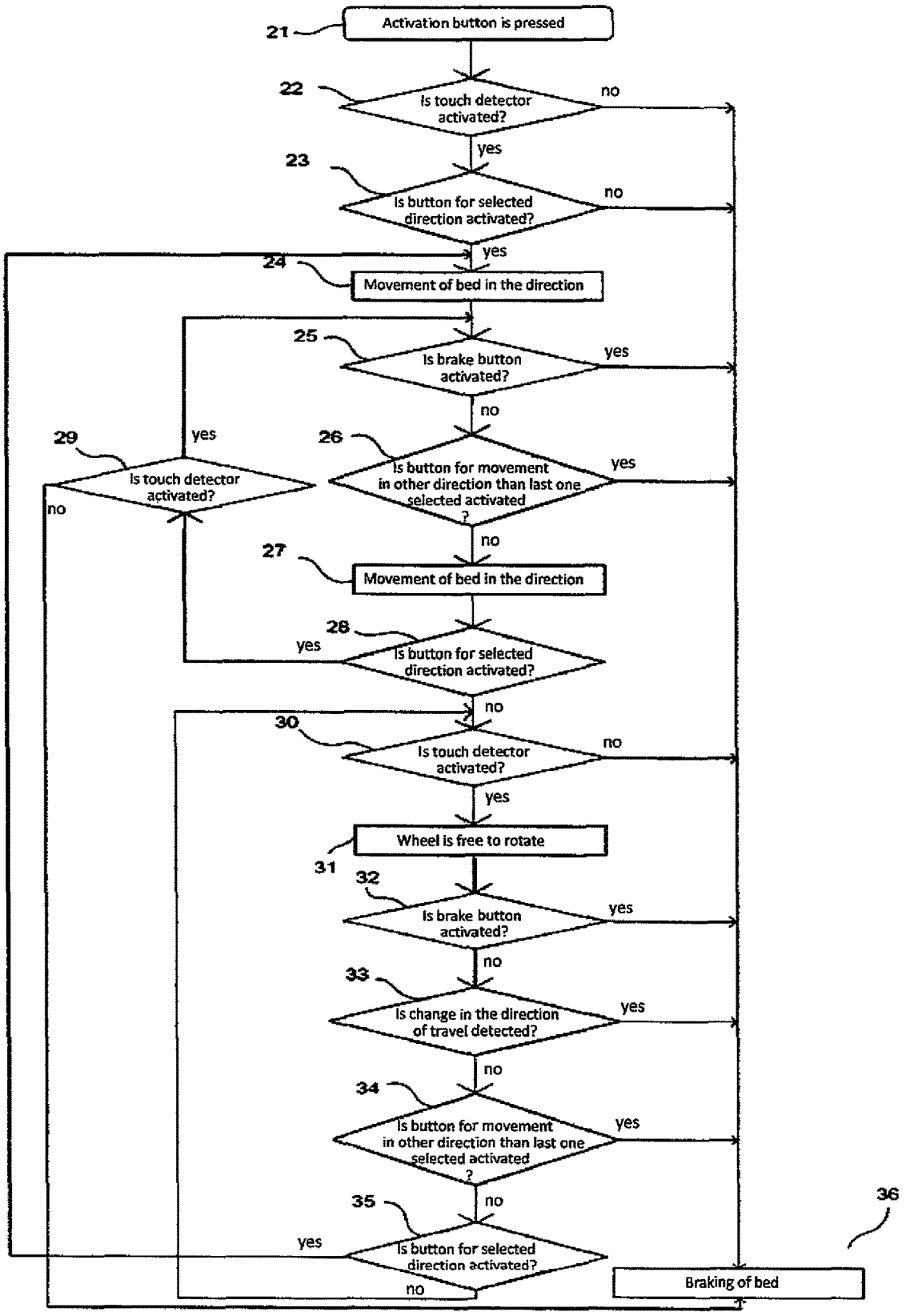
FIG. 5 shows an alternative embodiment of a simple algorithm for allowing manual movement of the bed.

FIG. 5 shows a detailed diagram of steps, which the system for propelling the bed 5 has to perform for the bed 1 to be permitted to provide motorized movement, manual mode, or for it to be braked. After the system starts operation, in step 21, by pressing the button for activation of the system 11, the processor unit 8 checks, in step 22, whether the touch sensor 16 is activated. If the processor unit 8 does not receive an activation signal from the touch sensor 16, the bed 1 remains braked (step 36). If the touch sensor 16 is activated, in step 23, the processor unit 8 evaluates whether the user had pressed any of the movement buttons 18, 19, 20. If no pressing of any movement button 18, 19, 20 is detected, the bed is still braked (step 36). If the user presses one of the movement buttons 18, 19, 20, a signal is sent by the processor unit 8 to the drive for propelling 37 to drive the bed 1 in the user-selected direction 24. It shows that, for movement of the bed 1 the touch sensor 16 must be activated and the user must also press one of the buttons for a selected direction 18, 19, 20. The start of movement of the bed 1 after the pressing of one of the movement buttons 18, 19, 20, doesn't have to be immediate but the command may be implemented after some predetermined time delay configured in the processor unit 8. In the next step 25, the processor unit 8 evaluates whether the button for brake activation 17 is pressed. If so, the system proceeds to step 36, i.e. braking. Another possibility for braking is in the case when the user has pressed a button for movement 18, 19, 20 in a direction other than that last selected, as it is described in step 26. It means that, if during the movement of the bed, the user presses a button for activation of the brake 17, or presses a movement button 18, 19, 20 for a direction other than previously selected, the bed 1 will continue to step 36, i.e. to the braking mode. If the selected button 18, 19, 20 is for the same direction as that originally selected, the bed 1 will continue in motion 27. In step 28 the processor unit 8 will evaluate whether the user is still holding down the active movement button 18, 19, 20 for the preselected direction. If so, and additionally, in step 29, the processor unit 8 still evaluates the touch sensor 16 as activated, the bed 1 continues in motion. If the touch sensor 16 is not activated, the bed 1 is braked (step 36). If the processor unit 8 evaluates that the user has released any of the movement buttons 18, 19, 20 for the pre-selected direction but is at the same time holding the touch sensor 16 activated (step 30), in step 31, the bed 1 proceeds to manual mode with free rotation of motorized wheel 7. If, in the manual mode 31, the processor unit detects a pressed button for brake activation 17 in step 32, step 36 brakes the bed 1 which also happens when the processor unit 8 detects a change in the direction of movement of the bed 1 (step 33). If none of the conditions of steps 32 and 33 are met, the processor unit 8 evaluates whether the user has pressed one of the movement buttons 18,19, 20. If the user has pressed button 18, 19, 20 for a direction (step 34) other than the one which the bed 1 was moving in the manual mode, the bed 1 is braked in step 36. If a movement button 18, 19, 20 is activated for the same direction in which the user was moving the bed 1 (step 35), the manual mode is terminated and the bed 1 returns to step 24, i.e. to motorized movement in the selected direction. If, in steps 34 and 35, the processor unit 8 does not detect any activated movement button 18, 19, 20, the bed 1 continues in the manual mode.

Figure 4:
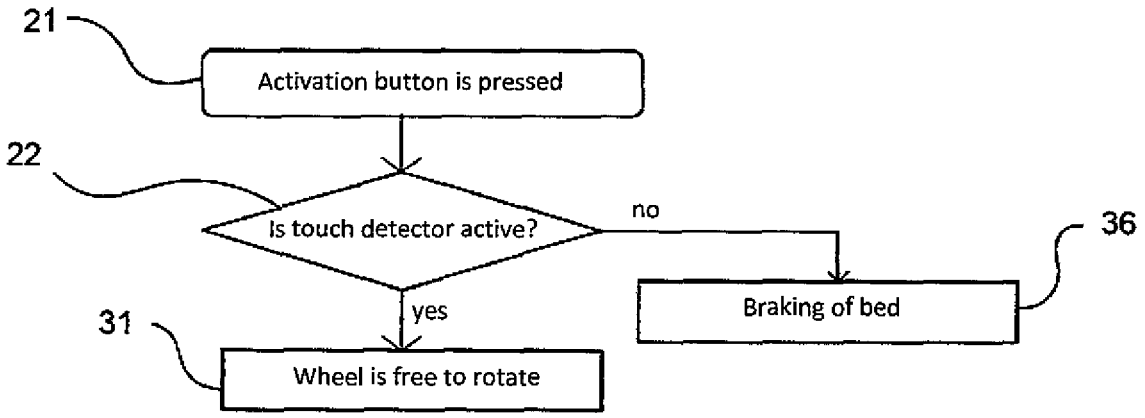
FIG. 4 shows a simplified diagram of the algorithm for starting movement of the bed or braking.

FIG. 4 shows an alternative solution of a simple algorithm which could be used to control the system for activating the manual mode 31. As soon as the system for propelling the bed 5 is activated (switched on) in step 21 by pressing the button for activation of the system 11, in step 22 it checks whether the user has activated the touch sensor 16. If the touch sensor 16 is activated by a user, the bed 1 starts the manual mode 31. If the touch sensor 16 is not activated the bed 1 is braked 36.

The invention claimed is:

1. A bed for maintaining a patient in the horizontal position including a mattress platform, a chassis for supporting the mattress platform, the chassis comprising wheels and system for propelling the bed, the system for propelling having at least two modes of operation for a motorized wheel, the bed further including a processor unit connected to a controller, wherein the controller is coupled to the bed, and wherein the controller includes at least one control element connected via the processor unit to a drive for propelling, the at least one control element for switching between the at least two modes of operation for the motorized wheel, one mode being for free rotation of the motorized wheel independently of the drive for propelling, and a second mode being for rotation of the motorized wheel dependent on the drive for propelling.

2. The bed according to claim 1, wherein in each of these two modes the drive for propelling is connected to a battery.

3. The bed according to claim 1, wherein the controller includes a touch sensor which must be activated concurrently with the at least one control element during the second mode of operation to enable movement of the bed by rotation of the motorized wheel dependent on the drive for propelling.

4. The bed according to claim 3, wherein the touch sensor is located proximate to the control element in such a way that it is possible to activate directly the touch sensor and control element using one hand.

5. The bed according to claim 3, wherein the touch sensor is comprised of at least one of: capacity sensor, optical sensor, induction sensor, resistance sensor, sensor detecting touch using surface acoustic wave (SAW) technology or infrared radiation sensor.

6. The bed according to claim 3, wherein the touch sensor is located on the top side of the controller.

7. The bed according to claim 3, wherein the mode for free rotation of the motorized wheel is activated by releasing the control element while at the same time, touching the touch sensor.

8. The bed according to claim 3, wherein release of the touch sensor activates a brake, which prevents movement of the bed.

9. The bed according to claim 1, wherein the system for propelling the bed includes a button for activation of the system.

10. The bed according to claim 9, wherein the button for system activation is located on the frame of the bed as part of a control panel.

11. The bed according to claim 10, wherein the control panel is connected by a cable to the controller.

12. The bed according to claim 11, wherein the control panel is out of reach of a patient on the bed.

13. The bed according to claim 1, wherein the at least one control element includes at least one button for forward movement and at least one button for reverse movement.

14. The bed according to claim 1, wherein the controller includes a brake button.

15. The bed according to claim 1, wherein the controller is configured to be hung on a bed end.

16. The bed according to claim 1, wherein the controller is configured to be hung on a side rail.

17. The bed according to claim 1, wherein the controller forms a part of a handrail connected to a frame of the bed.

18. The bed according to claim 1, wherein the controller has an ergonomic shape that promotes a natural one-handed control.

19. A bed for maintaining a patient in the horizontal position including a mattress platform, a chassis for supporting the mattress platform, the chassis comprising wheels and system for propelling the bed, the system for propelling the bed having at least two modes of operation, one mode being for free rotation of a motorized wheel independently of a drive for propelling, and a second mode being for rotation of the motorized wheel dependent on the drive for propelling; the bed further including a processor unit mounted in relation to the chassis, and a controller communicatively coupled to the processor unit, wherein the controller is attached to the bed and includes at least one button operable to switch between the at least two modes of operation, wherein the one mode for allowing free rotation of the motorized wheel is effected when the button is released, and the second mode for causing rotation of the motorized wheel dependent on the drive is effected when the control element is depressed.

* * * * *